United States Patent [19]

Flamboe, Jr. et al.

[11] Patent Number: 4,485,602

[45] Date of Patent: Dec. 4, 1984

[54] WALL PANEL POSITIVE ALIGNMENT DEVICE

[75] Inventors: Donald R. Flamboe, Jr.; David L. VanderKooi, both of Holland, Mich.

[73] Assignee: Trendway Corporation, Holland, Mich.

[21] Appl. No.: 428,156

[22] Filed: Sep. 29, 1982

[51] Int. Cl.[3] ..... E04H 1/00

[52] U.S. Cl. ..... 52/239; 52/126.4; 160/135; 160/229 R; 211/169

[58] Field of Search ..... 52/239, 241, 242, 126.4, 52/580; 160/351, 135, 229 R; 211/169

[56] References Cited

U.S. PATENT DOCUMENTS

| | | | |
|---|---|---|---|
| 2,594,378 | 4/1952 | Baldanza | 72/41 |
| 2,863,184 | 12/1958 | Hovind | 52/241 |
| 3,037,593 | 6/1962 | Webster | 52/476 |
| 3,239,986 | 3/1966 | Russell | 52/584 |
| 3,261,625 | 7/1966 | Cripe | 52/239 |
| 3,362,739 | 1/1968 | Staeger et al. | 287/20.92 |
| 3,473,273 | 10/1969 | Gunkel | 52/79 |
| 3,512,819 | 5/1970 | Morgan et al. | 287/189.36 |
| 3,537,217 | 11/1970 | Lickliter | 52/241 |
| 3,675,293 | 7/1972 | Hajduk | 29/150 |
| 3,744,826 | 7/1973 | Hawes | 287/189.36 |
| 3,842,509 | 10/1974 | Wyman et al. | 33/180 |
| 3,884,005 | 5/1975 | Wey | 52/585 |
| 3,894,316 | 7/1975 | Johnson | 24/73 |
| 3,926,529 | 12/1975 | Brooks | 403/4 |
| 3,973,855 | 8/1976 | Florence | 403/171 |
| 3,990,204 | 11/1976 | Hayworth et al. | 52/239 |
| 4,062,511 | 12/1977 | Ray | 248/300 |
| 4,067,655 | 1/1978 | Mayerhofer | 403/4 |
| 4,200,254 | 4/1980 | Nelson | 52/239 |
| 4,229,917 | 10/1980 | Textoris et al. | 52/239 |

FOREIGN PATENT DOCUMENTS 74626 5/1954 Netherlands .

*Primary Examiner*—John E. Murtagh
*Assistant Examiner*—Andrew Joseph Rudy
*Attorney, Agent, or Firm*—John A. Waters

[57] ABSTRACT

An alignment device for vertically aligning adjacent wall panels is adapted to be mounted in the lower corner of a wall panel to engage an identical alignment device and in an adjacent wall panel. The alignment device includes a central, vertical mounting column and a pair of horizontal, spaced and vertically offset alignment ledges extending in front of the lower portion of the mounting column. A horizontal wall panel rear support ledge extends to the rear of the lower portion of the mounting column. The alignment device provides positive vertical alignment with respect to two adjacent wall panels whether such panels are horizontally aligned or positioned angularly with respect to each other about a vertical axis.

9 Claims, 10 Drawing Figures

WALL PANEL POSITIVE ALIGNMENT DEVICE

BACKGROUND OF THE INVENTION

1. Field of the Invention

The present invention relates to an alignment device, and, more particularly, to a wall panel positive alignment device for vertically aligning adjacent wall panels.

2. Description of the Prior Art

The substantial growth and success of the portable wall panel industry in recent years has led to continual engineering and design improvements in the panel construction and in the wide variety of panel accessories and attachments that are now available. The key to the success of these portable wall panel systems has been their versatility in permitting easy office rearrangement to accomodate changing needs and desires. However, while ease of installation and rearrangement, as well as the open office appearance in the case of wall partitions which are not ceiling height, have been the key to the success of the systems, they would be less than satisfactory if not structurally sound once installed.

In the case of wall panel systems that are less than ceiling height, precise vertical alignment of adjacent wall panels is essential. Not only is vertical misalignment displeasing asthetically, it also adversely effects mounting and alignment of various accessories such as desks, shelves and the like. In the case of adjacent wall panels which are hinged to permit angular movement with respect to each other, vertical misalignment can cause undue wear and malfunction of the hinges which are typically lightweight and not structural support members.

While some systems rely upon leveling feet at the base of the wall panels to achieve vertical alignment, this results in a tedious and time consuming installation. Consequently, it has generally been preferred to use a structural vertical alignment device on each panel side edge which mates with a like device on the adjacent panel to provide automatic structural vertical alignment of the adjacent panels. Since in most cases angular pivoting of the panels with respect to each other must be permitted, conventional hinge-like devices have been utilized. Thus, conventional hinges or members with offset feet or ledges which interfit to mate with the hinge elements or offset ledges of a corresponding device on the adjacent panel have yielded generally satisfactory automatic vertical alignment of the panels. However, since these alignment devices are structural members, they are subjected to substantial weight and torque stresses. If the attachment of these alignment devices to the individual wall panels is not rigid and strong, repeated rearrangement of the wall panels invariably leads to loosening, breaking and general malfunction of these alignment devices. To utilize heavy-duty alignment devices to correct this problem is unsightly and expensive, and often requires complex installation procedures.

Heretofore, a totally satisfactory wall panel vertical alignment device has not been developed. Accordingly, it is the primary object of the present invention to provide a wall panel positive alignment device for vertically aligning adjacent wall panels which provides automatic vertical alignment, which is economical to produce and install, which is aesthetically pleasing and which has high structural strength and durability.

SUMMARY OF THE INVENTION

The wall panel positive alignment device of the present invention successfully overcomes the problems of prior devices. The unique alignment device is adapted to be mounted in the lower corner of a wall panel to engage an identical alignment device in an adjacent wall panel. The device includes a central vertical mounting column and a pair of horizontal, vertically offset alignment ledges extending in front of the lower portion of the mounting column and horizontally spaced from each other. The alignment ledges are of equal thickness, with the plane of the bottom surface of the upper ledge being adjacent to the plane of the top surface of the lower ledge. A horizontal wall panel rear support ledge extends to the rear of the lower portion of the mounting column.

Preferably, the alignment device is utilized with a wall panel which includes a vertical side edge channel and the alignment device mounting column is adapted to be mounted in the bottom end of the channel, with the bottom of the wall panel resting on the rear support ledge with means for rigidly attaching the rear support ledge to the bottom of the panel. The preferred embodiment also has a mounting means extending in front of the column and between the alignment ledges for rigidly attaching the alignment device to the bottom of the channel.

It is also preferred to provide a horizontal side support ledge extending from the side of the column on the top, rear of the lower alignment ledge having at least one anti-rotation rib extending upwardly from the top surface of the side support ledge or the upper ledge which is sized to engage a corresponding slot in the bottom of the panel channel.

Finally, the mounting column preferably has a vertical T-slot for engaging a vertical T-bar in the panel channel, and a vertical axial threaded bore for threadably receiving a threaded panel support foot.

DETAILED DESCRIPTION OF PREFERRED EMBODIMENTS

Figure 1:
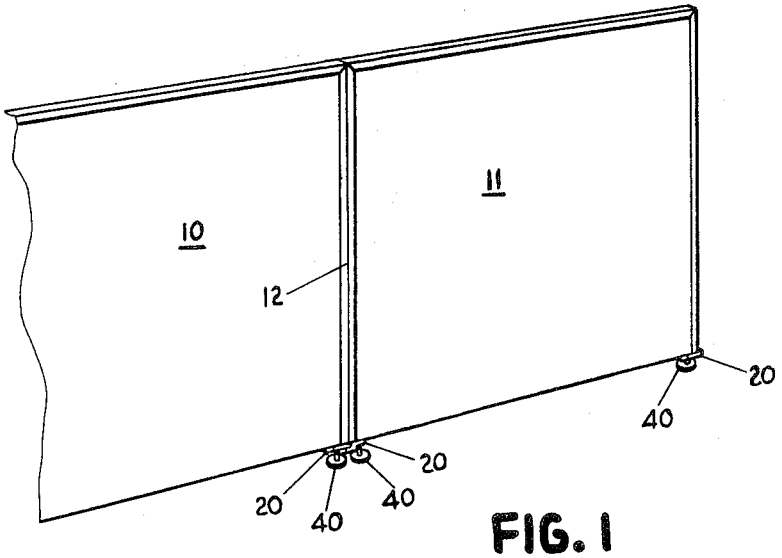
FIG. 1 is a perspective view of adjacent wall panels utilizing the positive alignment device of the present invention.
Figure 2:
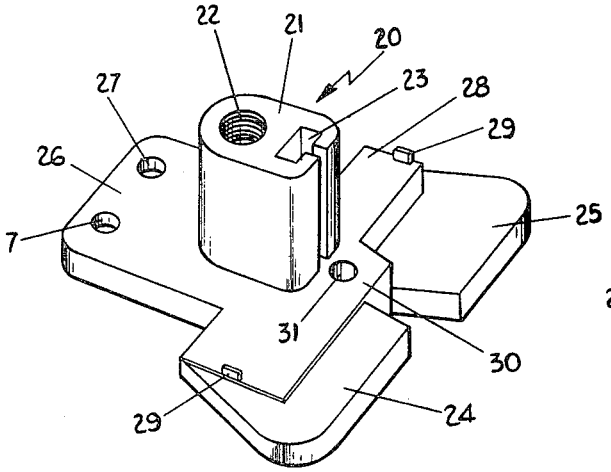
FIG. 2 is a perspective view of the preferred positive alignment device.
Figure 3:
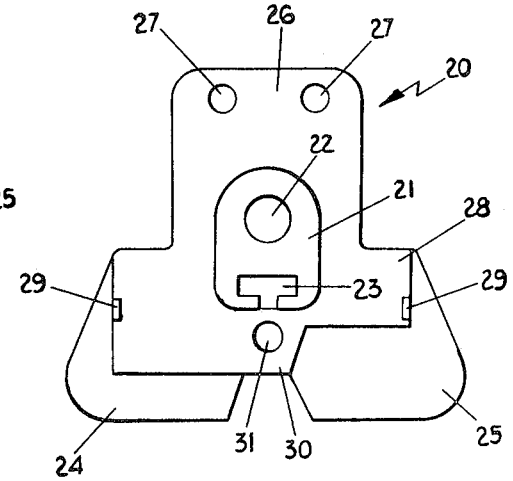
FIG. 3 is a planned view of the alignment device.

Referring to the drawings in greater detail, FIG. 1 illustrates adjacent wall panels 10 and 11 with positive alignment devices 20 mounted in the lower corners thereof and equipped with support feet 40. As shown, when adjacent alignment devices 20 are engaged, panels 10 and 11 are vertically aligned.

The preferred construction of positive alignment device 20 is best shown in FIGS. 2–6. Central vertical mounting column 21 has a threaded axial bore for threadably receiving mounting foot 40 and a vertical T-slot 23 for engaging a vertical T-bar 13 in the vertical side edge channel 12 of a wall panel.

Figure 4:
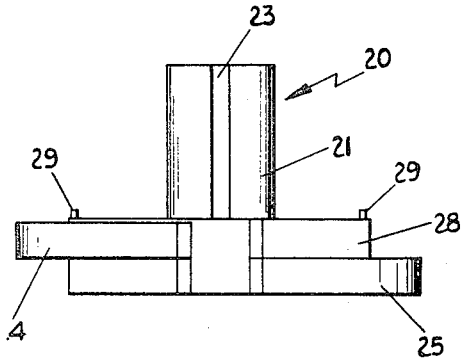
FIG. 4 is a front elevational view of the alignment device.
Figure 5:
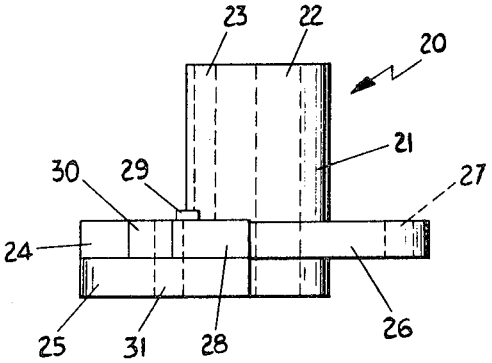
FIG. 5 is a side elevational view of the alignment device.
Figure 6:
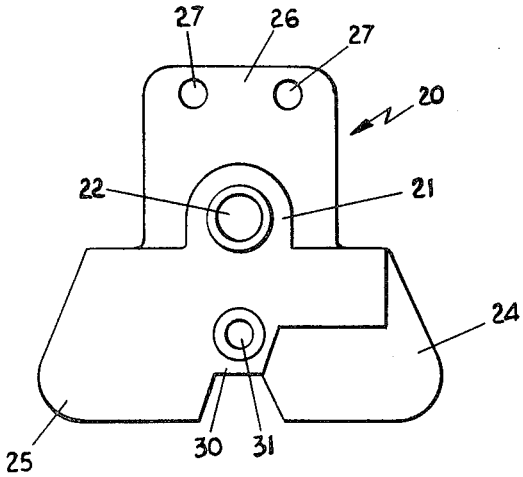
FIG. 6 is a bottom view of the alignment device.

Extending in front of the lower portion of mounting column 21 is a pair of horizontal, vertically offset alignment ledges, upper alignment ledge 24 and lower alignment ledge 25. The alignment ledges are horizontally spaced from each other, are of equal thickness and of mirror image configuration. As best shown in FIG. 4, the plane of the bottom surface of upper ledge 24 is adjacent to the plane of the top surface of lower ledge 25. This is important so that when opposing alignment devices are engaged, a solid structural engagement will be assured.

Horizontal wall panel rear support ledge 26 extends to the rear of the lower portion of mounting column 21 for rigid attachment to and support of the bottom of the wall panel. Holes 27 are provided to permit attachment of ledge 26 to the bottom of the wall panel by the use of convention wood screws 16 or the like.

Preferably, horizontal side support ledge 28 is provided extending from the side of column 21 on the top, rear of lower alignment ledge 25. With the top surface of side support ledge being in the same plane as the plane of the top surface of upper alignment ledge 24 and rear support ledge 26, a firm three-point support for the wall panel is provided. A pair of anti-rotation ribs 29 extend upwardly from the top surfaces of upper ledge 24 and side ledge 29. Ribs 29 are sized to engage corresponding slots 19 in the bottom of the panel channel 12 to provide anti-rotation structural stability to the panel-alignment device assembly.

An additional mounting means 30 preferably extends in front of column 21 and between alignment ledges 24 and 25. Hole 31 permits use of a conventional screw 17 or the like to be driven through hole 31 into a corresponding threaded hole 14 in the bottom of the panel channel member 12 to increase the strength and rigidity of the installation of the alignment device.

Figure 7:
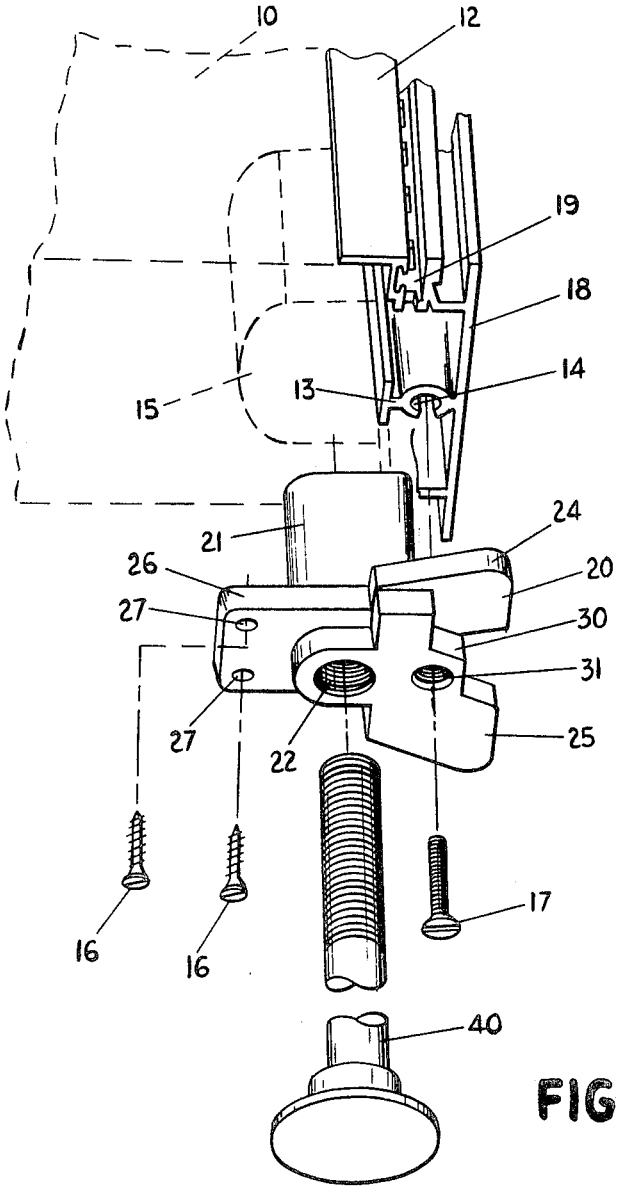
FIG. 7 is an exploded, bottom perspective view of the wall panel-alignment device-support foot assembly.

The mounting of alignment device 20 in the lower corner of a wall panel is best shown in FIG. 7 which is an exploded bottom perspective view of the assembly. A vertical side edge channel 12 is attached to the vertical side edge of wall panel 10 and includes a vertical T-bar member 13 and a threaded mounting hole 14 in the lower end thereof. A socket 15 is provided in the bottom corner of panel 10 which is sized to receive mounting column 21, preferably with a snug fit.

The assembly procedure is quick and easy. Column 21 is urged into socket 15 followed by driving screw 17 through hole 31 into threaded hole 14 and screws 16 through holes 27 into the bottom of panel 10. As column 21 is urged into socket 15, T-bar 13 will engage T-slot 23. Also, during this step, anti-rotation ribs 29 will be inserted into corresponding slots 19 of channel 12. Threaded support foot 40 is simply threaded into axial bore 22 to the desired depth.

Figure 8:
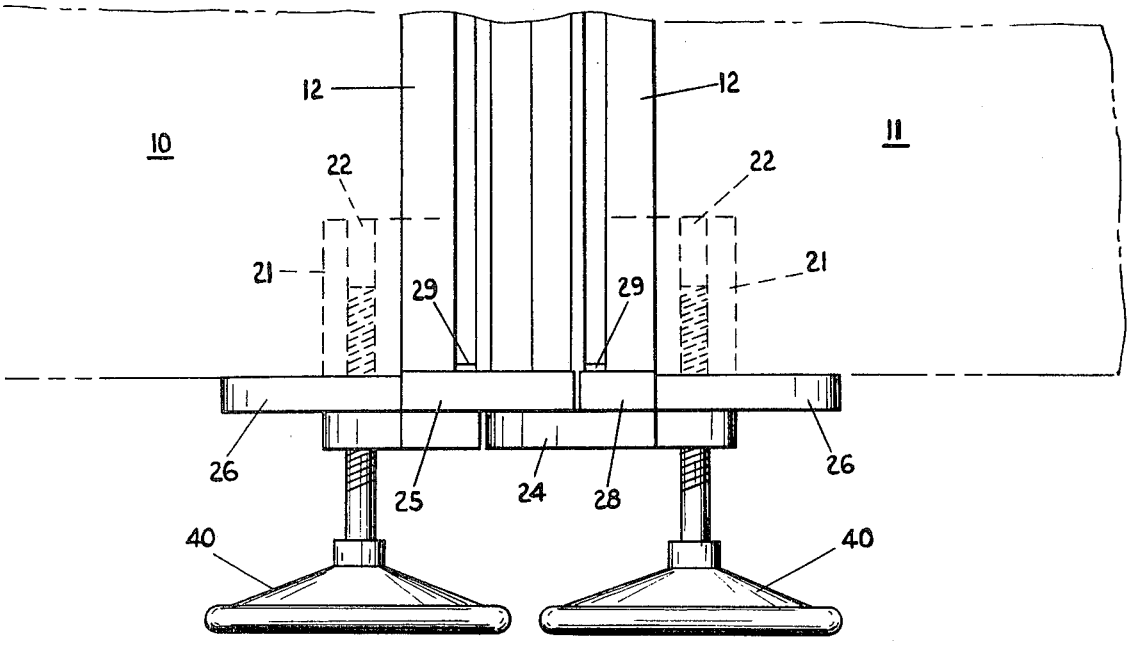
FIG. 8 is an enlarged, front elevational view of a pair of alignment devices installed in adjacent panels.
Figure 9:
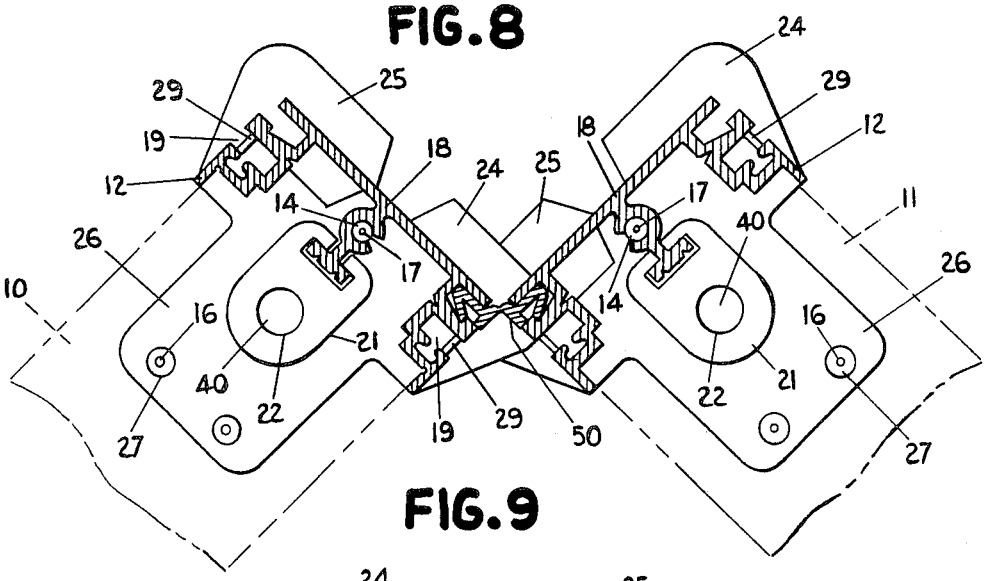
FIG. 9 is a cross-sectional plan view of a pair of alignment devices installed in adjacent wall panels which are positioned at an angle with respect to each other.
Figure 10:
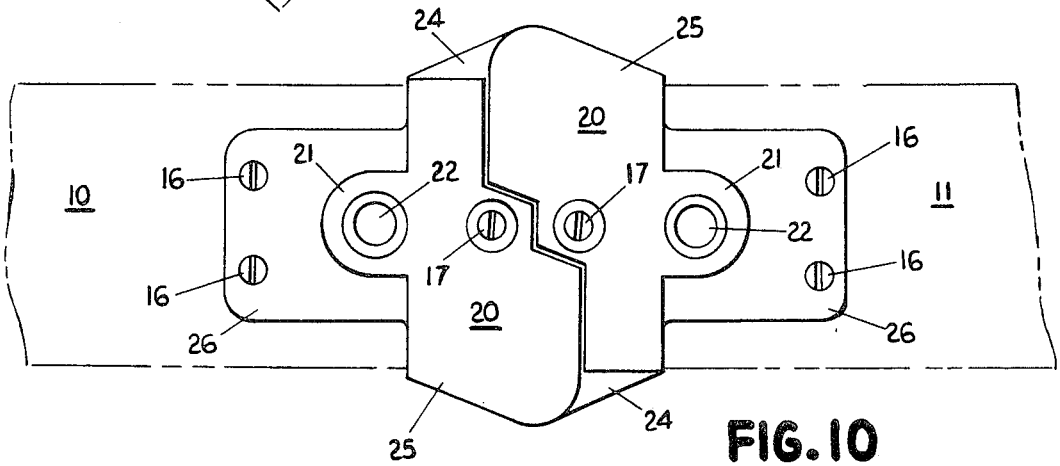
FIG. 10 is a bottom view of FIG. 8 with the support feet removed.

With alignment device 20 installed as described, only alignment ledges 24 and 25 will extend beyond outer face 18 of channel 12 (see FIG. 9). When installing two adjacent wall panels, such as 10 and 11, the alignment devices 20 installed in the bottom corners thereof, while identical members, will be opposed to each other and thus will interfit when urged together. Upper edge 24 on wall panel 10 will rest on lower ledge 25 of wall panel 11 and vice versa. See FIGS. 8 and 10.

In the embodiment shown in FIG. 9, the adjacent wall panels are connected by a vertical hinge member 50 to permit angular positioning of the wall panel members with respect to each other. In this type of angular installation, only one set of opposing alignment ledges will be in contact. Although this is sufficient for insuring vertical alignment, it is preferred that the configuration of the ledges 24 and 25 flare outwardly so as to extend beyond the side corner portion of the panel members as shown in FIG. 9. This increases the area of contact between the single set of alignment ledges for increased stability.

While alignment members 20 can be manufactured from a variety of rigid materials, it is preferred that they be constructed of diecast metals, such as zinc or aluminum, for maximum strength, economy and precision.

While the vertical alignment devices of the present invention are inexpensive to manufacture and easy to install, the unique combination of attachment means provides a strength and stability not heretofore achieved in alignment devices. The combination of column 21 in socket 15, T-bar 13 in T-slot 23, side support ledge 28, rear support ledge 26, mounting means 30 and attachment screws 16 and 17, together with anti-rotation ribs 29 in channel slots 19, provide an unusually sturdy and durable construction which can withstand a wide range of repeated forces and twisting torques without loostening or misalignment. The present invention has incorporated a conventional alignment principal of opposing offset ledges into a uniquely constructed product which functions as a superior wall panel positive alignment device for automatically vertically aligning adjacent wall panels.

While the preferred embodiments of the present invention have been described and illustrated, it will be obvious to those skilled in the art that various changes and modifications can be made without departing from the spirit of the present invention. Accordingly, the scope of the present invention is deemed to be limited only by the appended claims.

The embodiments of the invention in which an exclusive property or privilege is claimed are defined as follows:

1. A wall panel positive alignment device for vertically aligning adjacent wall panels wherein the wall panels have top and bottom and side edges, with side channels being rigidly mounted on the side edges and terminating at bottom ends at lower corners of the panel, the adjustement device being adapted to be mounted in the lower corner of one wall panel to engage an identical alignment device in an adjacent wall panel, the alignment device comprising:

a central vertical mounting column adapted to be mounted at the bottom end of the side channel;

a pair of horizontal, vertically offset alignment ledge including an upper ledge and a lower ledge extending in front of said mounting column and horizontally spaced from each other; the upper ledge having a bottom surface and the lower ledge having a top surface, the plane of the bottom surface of the upper ledge being adjacent to the plane of the top surface of the lower ledge;

horizontal wall panel rear support ledge extending to the rear of said mounting column and adapted to rest on the bottom edge of the panel;

a horizontal side support ledge extending from the side of said column on the top, rear of said lower alignment ledge, the top surface of said side support ledge being in the same plane as the plane of the top surface of said upper alignment ledge; and at least one anti-rotation rib extending upwardly from the top surface of said upper ledge or said side support ledge sized to engage a corresponding slot in the bottom of said channel.

2. An alignment device according to claim 1 wherein said rear support ledge comprises fastener opening means for rigidly attaching the rear support ledge to the bottom edge of said panel by means of fasteners, and mounting means extending in front of said column and between said alignment ledges for rigidly attaching the alignment device to the bottom end of said channel.

3. A wall panel positive alignment device according to claim 2 wherein said column has a vertical T-slot for engaging a vertical T-bar in said channel.

4. An alignment device according to claim 3 wherein said column has a vertical axial threaded bore for threadably receiving a threaded panel support foot.

5. A wall panel alignment device for aligning adjacent wall panels in a free standing wall panel system, wherein each wall panel has top and bottom edges and vertical side edges rigidly positioned on the panel, the bottom edge and bottom ends of the side edges of the panel forming lower corners of the panel, each alignment device comprising:

a central mounting column that fits under the lower corner of the panel;

a support ledge extending sideways and rearwardly from the mounting column and resting on the bottom edge of the wall panel at the sideways and rearward positions, the alignment device including means for attaching the support ledge in a fixed position on the bottom edge of the panel; and a pair of vertically offset alignment ledges extending forwardly from the central mounting column so as to protrude outwardly from the side edge of the wall panel, the ledges including an upper ledge and a lower ledge horizontally offset from each other, with the upper ledge having an upper surface that rests on and is supported by the lower corner of the panel, the upper ledge comprising a lower horizontal surface spaced below the upper surface, the lower surface of the upper ledge extending rearwardly to a point inward of the side edge of the panel, the lower ledge having an upper horizontal surface positioned in a plane adjacent the plane of the lower surface of the upper ledge, the lower ledge being formed such that when two adjacent panels having alignment devices thereon are brought into edgewise engagement, the opposing alignment devices mate with each other and maintain alignment of the panels, with the alignment ledges fitting together and resting on each other, the ledges extending outwardly a sufficient distance from their respective panels that the ledges extend under and overlap the fixed side edges of the adjacent panels when the panels are placed in edge to edge abutment.

6. An alignment device according to claim 5 wherein the central mounting column comprises an elongated member that extends upwardly from the plane of the support ledge, the elongated member being designed to fit in a recess in the bottom edge of the panel behind the side edge, the elongated member having a threaded vertical opening therethrough for receiving and supporting a threaded support rod of a leveling foot.

7. An alignment device according to claim 6 wherein the side edge is formed of metal and is rigidly fastened to the panel, the side edge including a T-shaped projection extending inwardly therefrom at the bottom and thereof, the panel including a recess at the lower corner behind the side edge, the central mounting column fitting in the recess and including a T-shaped slot that fits over the T-shaped projection to assist in locking the alignment device in position in the panel.

8. An alignment device according to claim 5 wherein the means for mounting the support ledge on the bottom edges of the panel include vertical openings in the support ledge that receive threaded fasteners that extend into threading engagement with the bottom edge of the panel.

9. An alignment device according to claim 6 wherein the support ledge includes upwardly extending projections that fit in recesses in the bottom edge of the panel and thereby prevent rotation of the alignment device about a vertical axis.

* * * * *